US010960289B1

(12) United States Patent
Colcord

(10) Patent No.: US 10,960,289 B1
(45) Date of Patent: Mar. 30, 2021

(54) TREADMILL BELT GUARD

(71) Applicant: Brian Colcord, Andover, MA (US)

(72) Inventor: Brian Colcord, Andover, MA (US)

( * ) Notice: Subject to any disclaimer, the term of this patent is extended or adjusted under 35 U.S.C. 154(b) by 0 days.

(21) Appl. No.: 17/103,785

(22) Filed: Nov. 24, 2020

(51) Int. Cl.

| | |
|---|---|
| ***A63B 71/00*** | (2006.01) |
| ***A63B 21/22*** | (2006.01) |
| ***A63B 22/02*** | (2006.01) |
| *A63B 22/00* | (2006.01) |
| *A63B 69/00* | (2006.01) |

(52) U.S. Cl.
CPC ..... *A63B 71/0054* (2013.01); *A63B 21/222* (2015.10); *A63B 22/02* (2013.01); *A63B 22/0046* (2013.01); *A63B 69/0028* (2013.01); *A63B 2069/0037* (2013.01); *A63B 2071/009* (2013.01)

(58) Field of Classification Search
CPC . A63B 22/02; A63B 22/0046; A63B 69/0028; A63B 71/0054; A63B 2069/0037; A63B 2071/009
See application file for complete search history.

(56) References Cited

U.S. PATENT DOCUMENTS

| | | | | |
|---|---|---|---|---|
| 6,390,955 | B1 * | 5/2002 | Wang | A63B 22/02 482/54 |
| 6,685,599 | B2 * | 2/2004 | Wang | A63B 22/02 482/54 |
| 6,716,142 | B2 * | 4/2004 | Kuo | A63B 22/0235 482/51 |
| 6,786,853 | B2 * | 9/2004 | Wu | A63B 22/0257 482/54 |
| 6,860,839 | B1 * | 3/2005 | Dice | A63B 22/02 482/51 |
| 2010/0105527 | A1 * | 4/2010 | Johnson | A63B 22/02 482/54 |

* cited by examiner

*Primary Examiner* — Megan Anderson

(57) ABSTRACT

A treadmill belt guard includes a weighted cylindrical body, a first arm, a second arm, a first adaptor, a second adaptor, a first interlocking fastener, and a second interlocking fastener. The first arm is externally connected onto a lateral surface of the weighted cylindrical body. The second arm is externally connected onto the lateral surface of the weighted cylindrical body. The first arm and the second arm are positioned parallel to each other. The first adaptor is terminally mounted to the first arm through the first interlocking fastener. The first arm is positioned in between the first adaptor and the weighted cylindrical body. The second adaptor is terminally mounted to the second arm through the second interlocking fastener. The second arm is positioned in between the second adaptor and the weighted cylindrical body.

6 Claims, 6 Drawing Sheets

TREADMILL BELT GUARD

FIELD OF THE INVENTION

The present invention relates generally to safety devices of treadmills. More specifically, the present invention is a treadmill belt guard that can be attached to the rear end of the treadmill to prevent suction of foreign objects.

BACKGROUND OF THE INVENTION

Treadmills have been used as exercising machines for running or walking in one place. In other words, a treadmill is an indoor exercise machine and provides an effective solution in the event of unpleasant weather conditions that can prevent someone from exercising outdoor. More specifically, treadmills have a moving platform so that the user can walk, jog, or run on the moving platform to complete their exercise. The moving platform is generally a wide conveyor belt that is driven by an electric motor and other necessary components. The conveyor belt moves from front end to the rear end of the treadmill, requiring the user to walk or run at a speed matching that of the conveyor belt. The rate at which the conveyor belt moves is the rate of walking or running as the speed of conveyor may be controlled and measured. One of the main safety problems with the existing treadmills is that foreign objects (toys and exercising equipment) can get clinched to the conveyor belt and drag underside of the treadmill. Resultantly, these foreign objects can unbalance and tip over the treadmill thus compromising the safety of the user.

It is therefore an objective of the present invention to provide a treadmill belt guard prevents the suction of foreign objects into the underside of the conveyor belt. More specifically, the present invention is attached to the rear end of the treadmill and behind the conveyor belt so cover the gap between the underside of the conveyor belt and the floor. The present invention is also a weighted body so that the present invention cannot be easily move away from the floor. As a result, the present invention is able to prevent accidental suction of unnecessary objects or materials that can potentially damage the treadmill or compromise the safety of the user.

DETAIL DESCRIPTIONS OF THE INVENTION

All illustrations of the drawings are for the purpose of describing selected versions of the present invention and are not intended to limit the scope of the present invention.

Figure 1:
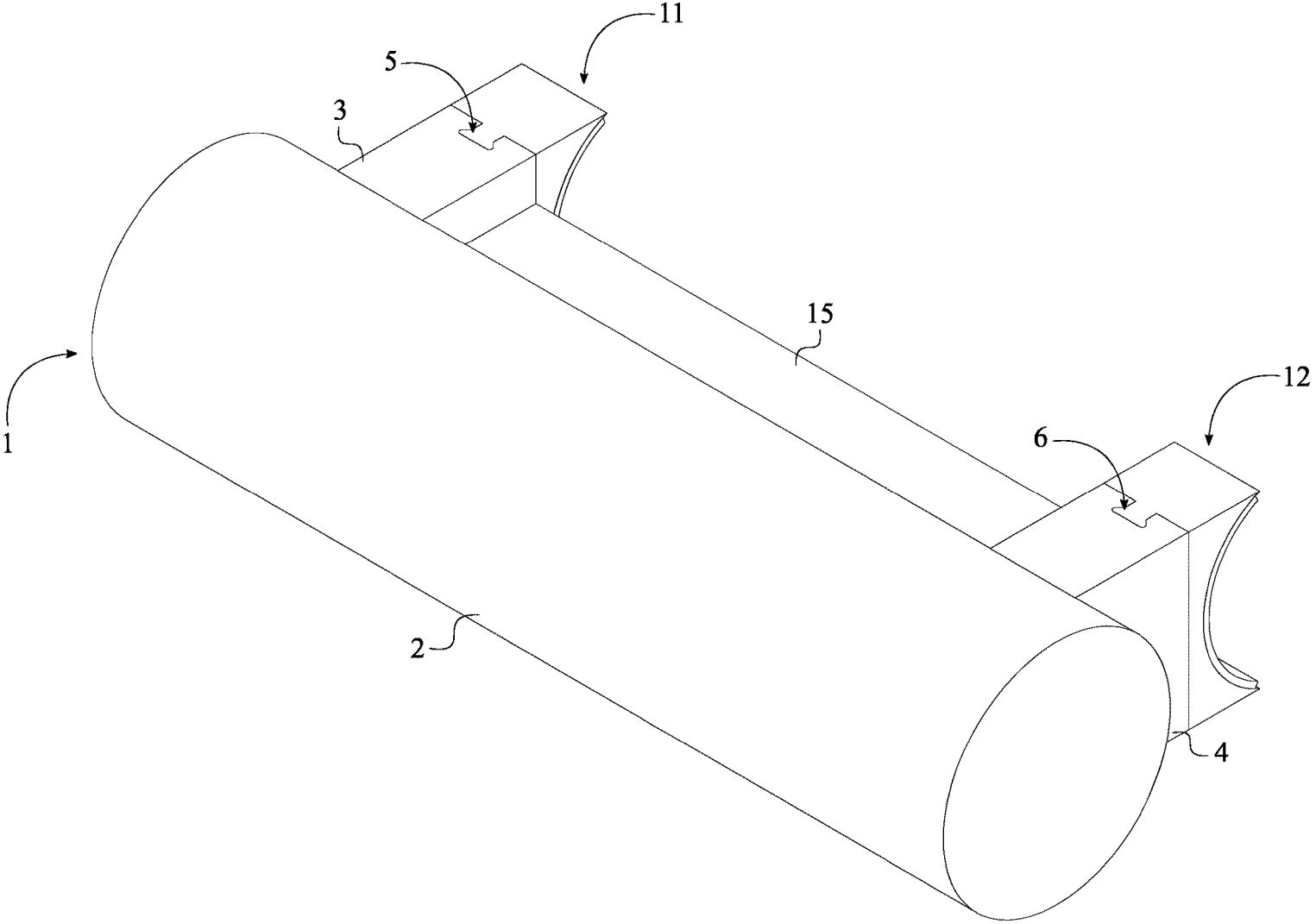
FIG. 1 is a front perspective view of the present invention, wherein the first adaptor and the second adaptor are designed to fit around the curved or flat backend of the treadmill.
Figure 2:
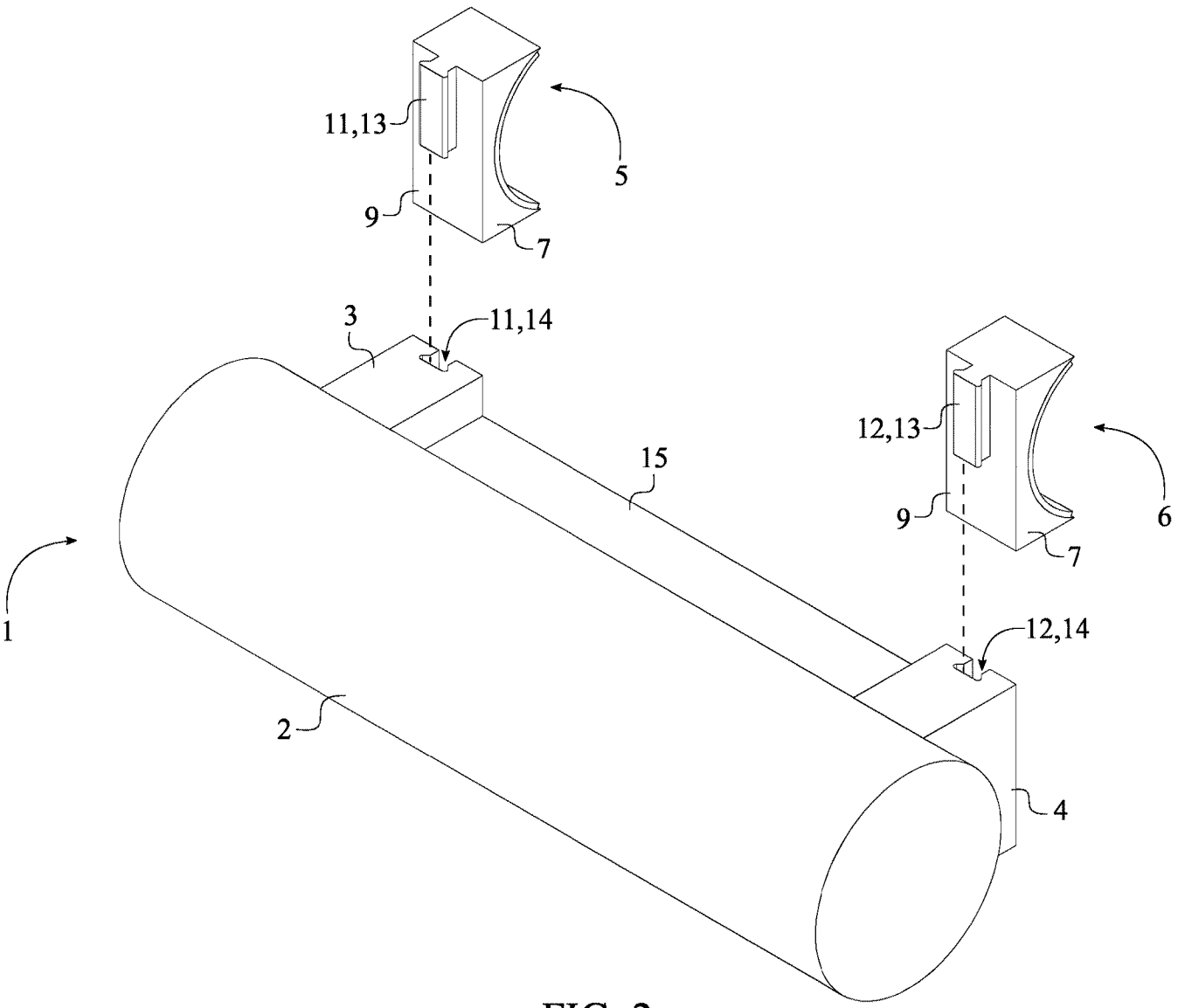
FIG. 2 is a front exploded view of the present invention, wherein the first adaptor and the second adaptor are designed to fit around the curved or flat backend of the treadmill.
Figure 3:
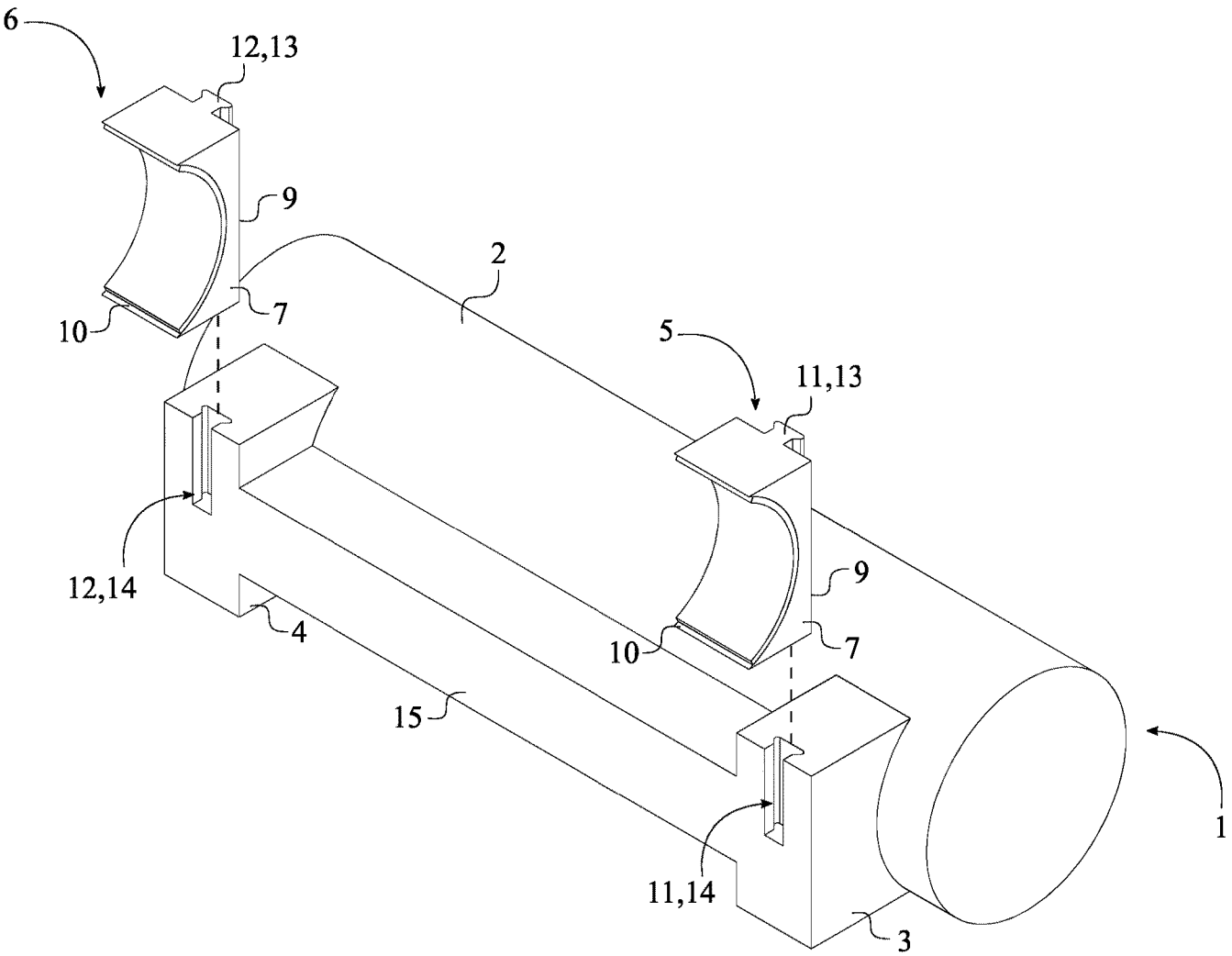
FIG. 3 is a rear exploded view of the present invention, wherein the first adaptor and the second adaptor are designed to fit around the curved or flat backend of the treadmill.

The present invention is a treadmill belt guard and prevents the conveyor belt of the treadmill from gripping unwanted foreign objects into the underside of the conveyor belt. More specifically, the present invention covers the gap between the underside of the conveyor belt and the floor thus preventing suction of materials and objects into the underside of the conveyor belt. As a result, the present invention is able to eliminate unbalance and tip over of the treadmill that can be unsafe for the user. The present invention comprises a weighted cylindrical body 1, a first arm 3, a second arm 4, a first adaptor 5, a second adaptor 6, a first interlocking fastener 11, and a second interlocking fastener 12 as shown in FIG. 1-3. In reference to the general configuration of the present invention, the first arm 3 and the second arm 4 are laterally connected to the weighted cylindrical body 1 so that the present invention can be mounted to the back end of the treadmill through the first adaptor 5 and the second adaptor 6.

In reference to FIG. 1-6, the weighted cylindrical body 1 functions as the barrier between the conveyor belt and the unwanted foreign objects thus stopping them from entering into the underside of the treadmill. A length 17 of the weighted cylindrical body 1 is preferably larger than the width of the treadmill so that the conveyer belt can be fully covered from the back end of the conveyor belt. The weighted element of the weighted cylindrical body 1 can be achieved through manufactured material of the present invention or a weighted center core. Due to the weighted element of the weighted cylindrical body 1, the present invention cannot be moved by any surrounding objects or unwanted foreign objects. As a result, the weighted cylindrical body 1 is able to cover the gap between the underside of the conveyer belt and the floor.

Figure 4:
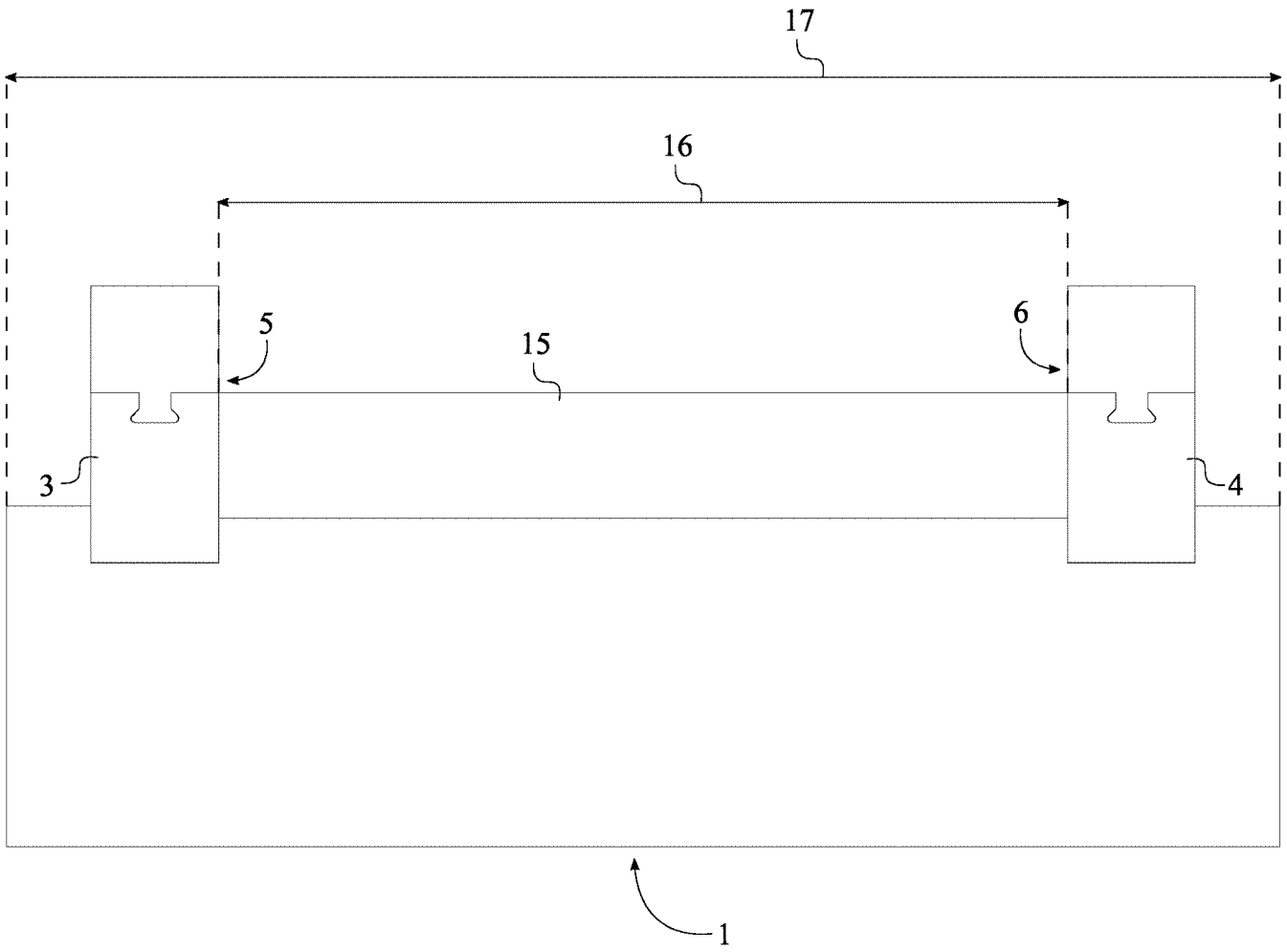
FIG. 4 is a top view of the present invention.

The first arm 3 and the second arm 4 are configured into rectangular shape and functions as the connector arms of the weighted cylindrical body 1. In reference to FIG. 1-3, the first arm 3 is externally connected onto a lateral surface 2 of the weighted cylindrical body 1. The second arm 4 is externally connected onto the lateral surface 2 of the weighted cylindrical body 1. The first arm 3 and the second arm 4 are positioned parallel to each other so that the weighted cylindrical body 1 can be evenly placed atop the floor and connected onto the back end of the treadmill. As shown in FIG. 4, a distance 16 between the first arm 3 and the second arm 4 is smaller than the length 17 of the weighted cylindrical body 1 in order to accommodate the full length of the weighted cylindrical body 1 in comparison to the width of the conveyor belt.

In reference to FIG. 1-3, the present invention further comprises a support 15 so that the parallel positioning of the first arm 3 and the second arm 4 can be structurally improved. More specifically, the support 15 is terminally connected to the first arm 3 and the second arm 4 in such a way that the support 15 is linearly extended in between the first arm 3 and the second arm 4. Depending on different embodiments of the present invention, the support 15 can be connected onto the lateral surface 2 of the weighted cylindrical body 1 or positioned offset from the lateral surface 2 of the weighted cylindrical body 1.

The first adaptor 5 and the second adaptor 6 function as mounting bodies of the present invention so that the first arm 3 and the second arm 4 can be attached to the back end of the treadmill. In reference to FIG. 3, the first adaptor 5 is terminally mounted to the first arm 3 through the first interlocking fastener 11. The second adaptor 6 is terminally mounted to the second arm 4 through the second interlocking fastener 12. More specifically, the first arm 3 is positioned in between the first adaptor 5 and the weighted cylindrical body 1 so that the first arm 3 can be mounted to the back end of the treadmill through the first adaptor 5. Similarly, the second arm 4 is positioned in between the second adaptor 6 and the weighted cylindrical body 1 thus attaching the second arm 4 to the back end of the treadmill through the second adaptor 6. Furthermore, the first adaptor 5 and the second adaptor 6 can utilize any of the industry standard attachment methods or apparatus so that the present invention can be mounted to the back end of the treadmill. For example, the first adaptor 5 and the second adaptor 6 can utilize hook-and-loop fasteners, adhesive strips, magnetic attachments, mechanical fasteners, male and female fasteners, or any other types of fasteners to mount the first adaptor 5 and the second adaptor 6 to the back end of the treadmill.

In reference to FIG. 2-3, the first interlocking fastener 11 and the second interlocking fastener 12 each comprises a male feature 13 and a female feature 14. The female feature 14 of the first interlocking fastener 11 traverses into the first arm 3. The male feature 13 of the first interlocking fastener 11 connected onto a flat-arm mounting surface 9 of the first adaptor 5. Similarly, the female feature 14 of the second interlocking fastener 12 traverses into the second arm 4. The male feature 13 of the second interlocking fastener 12 connected onto a flat-arm mounting surface 9 of the second adaptor 6. As a result, the user can easily interlock the first adaptor 5 with the first arm 3 and the second adaptor 6 with the second arm 4. The removable mounting feature of the first adaptor 5 and the second adaptor 6 is an essential feature within the present invention so that the present invention can be compatible with a curved back end of the treadmill and a flat back end of the treadmill.

Figure 5:
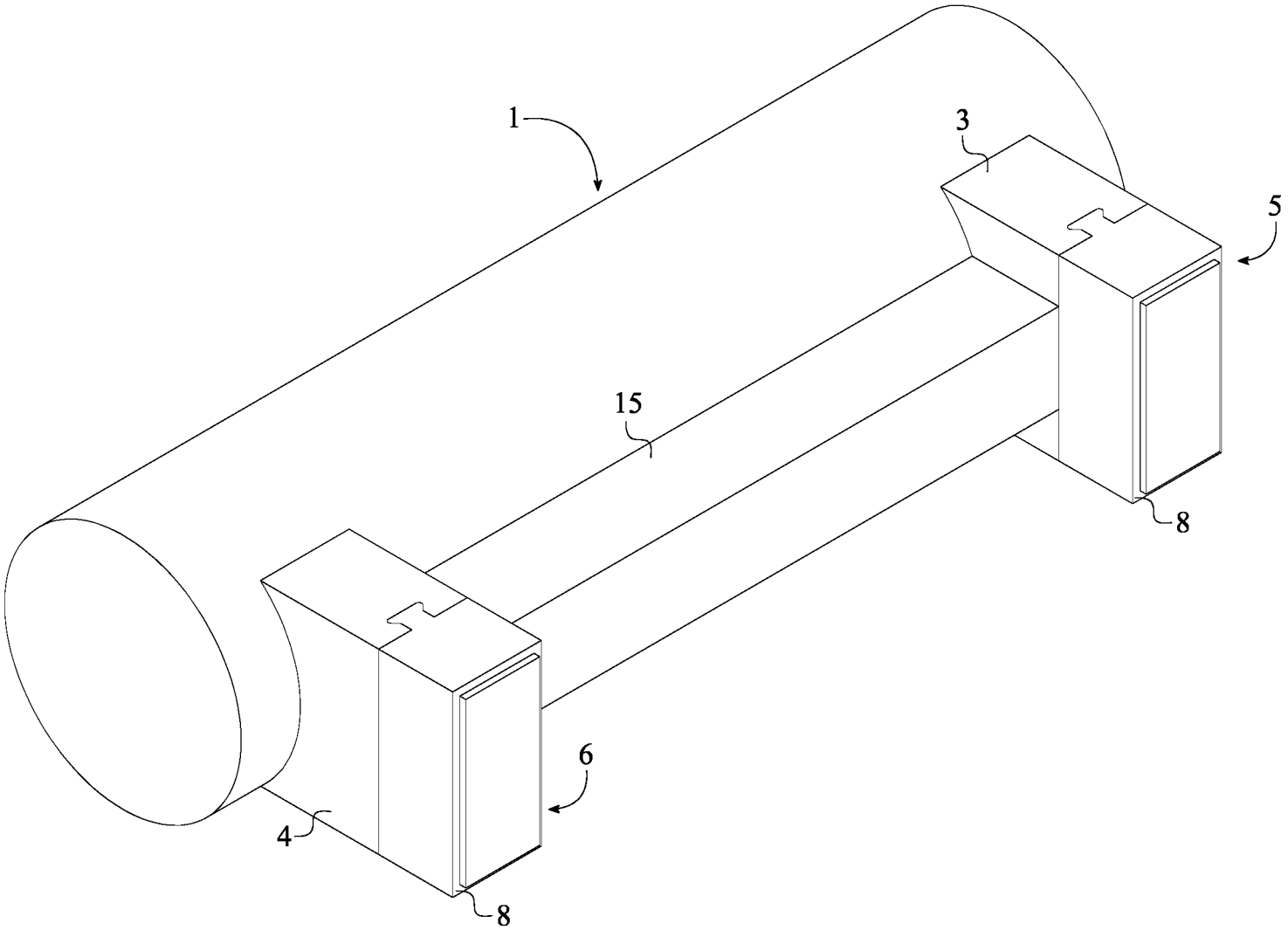
FIG. 5 is a rear perspective view of the present invention, wherein the first adaptor and the second adaptor are designed to fit along the flat backend of the treadmill.
Figure 6:
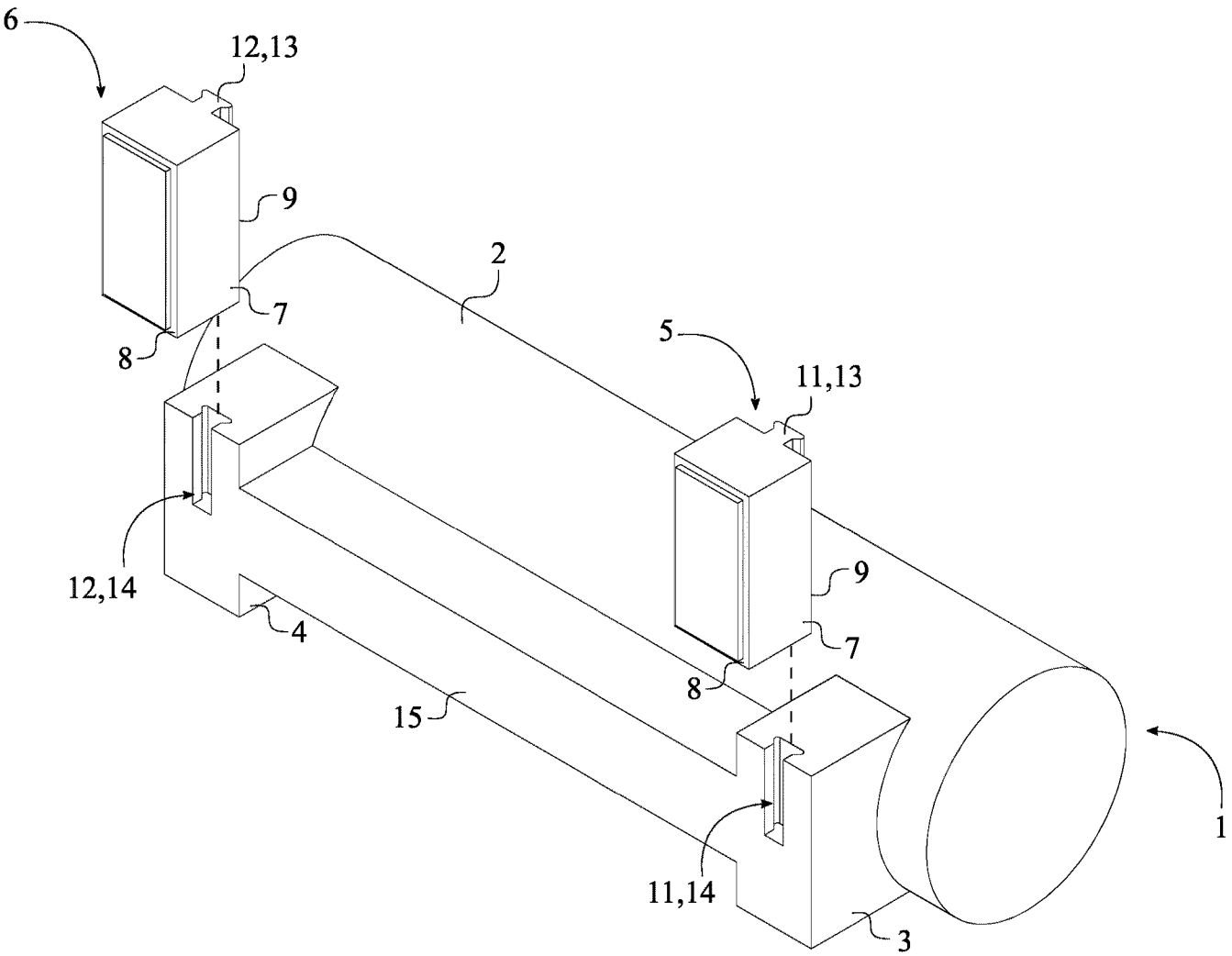
FIG. 6 is a rear exploded view of the present invention, wherein the first adaptor and the second adaptor are designed to fit along the flat backend of the treadmill.

In reference to the flat back end of the treadmill, the first adaptor 5 and the second adaptor 6 each comprises a body 7, a flat-treadmill mounting surface 8, and the flat-arm mounting surface 9. As shown in FIG. 5-6, the flat-treadmill mounting surface 8 and the flat-arm mounting surface 9 are oppositely positioned of each other about the body 7. The flat-treadmill mounting surface 8 is positioned parallel to the flat-arm mounting surface 9 thus providing a rectangular shape for the first adaptor 5 and the second adaptor 6. Furthermore, the flat-arm mounting surface 9 is oriented towards the weighted cylindrical body 1 so that the first adaptor 5 and the second adaptor 6 can respectively be interlocked with the first arm 3 and the second arm 4 via the first interlocking fastener 11 and the second interlocking fastener 12. The flat-treadmill mounting surface 8 is oriented towards the flat back end of the treadmill so that the first adaptor 5 and the second adaptor 6 can be mounted to the flat back end of the treadmill via one of the aforementioned industry standard attachment methods or apparatus.

In reference to the curved back end of the treadmill, the first adaptor 5 and the second adaptor 6 each comprising the body 7, a curved-treadmill mounting surface 10, and the flat-arm mounting surface 9. As shown in FIG. 1-3, the curved-treadmill mounting surface 10 and the flat-arm mounting surface 9 are oppositely positioned of each other about the body 7. Furthermore, the flat-arm mounting surface 9 is oriented towards the weighted cylindrical body 1 so that the first adaptor 5 and the second adaptor 6 can respectively be interlocked with the first arm 3 and the second arm 4 via the first interlocking fastener 11 and the second interlocking fastener 12. The curved-treadmill mounting surface 10 is oriented towards the curved back end of the treadmill so that the first adaptor 5 and the second adaptor 6 can be mounted to the flat back end of the treadmill via one of the aforementioned industry standard attachment methods or apparatus.

Although the invention has been explained in relation to its preferred embodiment, it is to be understood that many other possible modifications and variations can be made without departing from the spirit and scope of the invention as hereinafter claimed.

What is claimed is:

1. A treadmill belt guard comprising;
a weighted cylindrical body;
a first arm;
a second arm;
a first adaptor;
a second adaptor;
a first interlocking fastener;
a second interlocking fastener;
the first arm being externally connected onto a lateral surface of the weighted cylindrical body;
the second arm being externally connected onto the lateral surface of the weighted cylindrical body;
the first arm and the second arm being positioned parallel to each other;
the first adaptor being terminally mounted to the first arm through the first interlocking fastener;
the first arm being positioned in between the first adaptor and the weighted cylindrical body;
the second adaptor being terminally mounted to the second arm through the second interlocking fastener; and
the second arm being positioned in between the second adaptor and the weighted cylindrical body; the treadmill belt guard is configured to be attached to a back end of a treadmill.

2. The treadmill belt guard as claimed in claim 1 comprising;
a support;
the support being terminally connected to the first arm and the second arm; and
the support being linearly extended in between the first arm and the second arm.

3. The treadmill belt guard as claimed in claim 1, wherein a distance between the first arm and the second arm is smaller than a length of the weighted cylindrical body.

4. The treadmill belt guard as claimed in claim 1 comprising;
the first interlocking fastener and the second interlocking fastener each comprising a male feature and a female feature;
the female feature of the first interlocking fastener traversing into the first arm;
the male feature of the first interlocking fastener connected onto a flat-arm mounting surface of the first adaptor;
the female feature of the second interlocking fastener traversing into the second arm; and
the male feature of the second interlocking fastener connected onto a flat-arm mounting surface of the second adaptor.

5. The treadmill belt guard as claimed in claim 1 comprising;
the first adaptor and the second adaptor each comprising a body, a flat-treadmill mounting surface, and a flat-arm mounting surface;

the flat-treadmill mounting surface and the flat-arm mounting surface being oppositely positioned of each other about the body of each of the first and second adaptors;

each of the flat-treadmill mounting surface being positioned parallel to a respective one of the flat-arm mounting surfaces; and each of the flat-arm mounting surfaces being oriented towards the weighted cylindrical body.

6. The treadmill belt guard as claimed in claim 1 comprising;

the first adaptor and the second adaptor each comprising a body, a curved-treadmill mounting surface, and a flat-arm mounting surface;

the curved-treadmill mounting surface and the flat-arm mounting surface being oppositely positioned of each other about the body of each of the first and second adaptors; and each of the flat-arm mounting surfaces being oriented towards the weighted cylindrical body.

* * * * *